US012303740B2

(12) United States Patent
Tsai

(10) Patent No.: US 12,303,740 B2
(45) Date of Patent: May 20, 2025

(54) RESISTANCE TREADMILL WITH CURVED RUNNING DECK

(71) Applicant: Fu An Wellness Technology, Inc., Taipei (TW)

(72) Inventor: Shih-Ying Tsai, Taipei (TW)

(73) Assignee: Fu An Wellness Technology, Inc., Taipei (TW)

( * ) Notice: Subject to any disclaimer, the term of this patent is extended or adjusted under 35 U.S.C. 154(b) by 140 days.

(21) Appl. No.: 18/473,530

(22) Filed: Sep. 25, 2023

(65) Prior Publication Data

US 2025/0001245 A1 Jan. 2, 2025

(30) Foreign Application Priority Data

Jun. 30, 2023 (TW) ..... 112124644

(51) Int. Cl.
*A63B 22/02* (2006.01)

(52) U.S. Cl.
CPC ..... *A63B 22/0285* (2013.01); *A63B 22/0235* (2013.01); *A63B 22/025* (2015.10); *A63B 2209/08* (2013.01); *A63B 2225/055* (2013.01); *A63B 2225/09* (2013.01)

(58) Field of Classification Search
CPC ..... A63B 22/0285; A63B 22/0235; A63B 22/025; A63B 2209/08; A63B 2225/055; A63B 2225/09; A63B 21/00192; A63B 21/0089; A63B 21/012; A63B 21/4015; A63B 22/0023; A63B 22/0242; A63B 71/0009; A63B 2208/0204; A63B 2209/00; A63B 2209/10; A63B 2225/05; A63B 22/02; A63B 2022/206; A43B 1/0054; A43B 1/0081; A43B 5/06; A43B 5/18; A43B 13/122; A43B 13/22
See application file for complete search history.

(56) References Cited

U.S. PATENT DOCUMENTS

| | | | | |
|---|---|---|---|---|
| 11,800,909 | B2 * | 10/2023 | Pesce | A63B 21/4035 |
| 2014/0235410 | A1 * | 8/2014 | Lee | A63B 22/0242 482/54 |
| 2016/0321947 | A1 * | 11/2016 | Toronto | G09B 19/003 |
| 2017/0266534 | A1 * | 9/2017 | Watterson | A63B 24/0087 |
| 2021/0291014 | A1 * | 9/2021 | Alothmany | A61B 5/6807 |
| 2022/0142290 | A1 * | 5/2022 | Pesce | A63B 21/4035 |
| 2022/0212056 | A1 * | 7/2022 | Bayerlein | A63B 22/0214 |
| 2022/0347516 | A1 * | 11/2022 | Taylor | A63B 22/0605 |

* cited by examiner

*Primary Examiner* — Garrett K Atkinson
(74) *Attorney, Agent, or Firm* — Wang Law Firm, Inc.

(57) ABSTRACT

A resistance treadmill with curved running deck is provided with a pair of conveyors positioned between a pair of first drive wheels and a pair of second drive wheels on a base of the treadmill. A plurality of running decks are arranged along the circumference of the conveyors, and a portion of the running decks, located above the base, is supported by a pair of curved-shaped bars to form the curved running deck. Each of the running decks is equipped with a first attachment element on its upper surface. There is a second attachment element intended to be attached to the runner's foot or shoe. The second attachment element can be detachably attached to the first attachment element, creating resistance between the runner's foot or shoe and the treadmill when the user runs on the deck through the mutual attachment of the first and second attachment elements.

12 Claims, 8 Drawing Sheets

RESISTANCE TREADMILL WITH CURVED RUNNING DECK

CROSS-REFERENCE TO RELATED APPLICATION

This application claims the priority of Taiwanese patent application No. 112124644, filed on Jun. 30, 2023, which is incorporated herewith by reference.

BACKGROUND OF THE INVENTION

1. Field of the Invention

The present invention relates generally to the field of sports equipment, and more particularly, to resistance treadmills with curved running deck that the runner's shoes and the treadmill can be attached to each other to generate resistance when runners are running on the treadmills.

2. The Prior Arts

For those who enjoy sports and fitness, treadmills are generally welcomed because the activity is not affected by external environment and climate. The running deck of the conventional treadmill is mainly provided with drive wheels at both ends of the base, and the running deck is passed around the two sets of drive wheels to form a loop. The upper side of the loop-shaped running deck is located above the deck of the base. The treadmill can further be categorized as: planar type or curved type, with or without electrical power, and providing adjustable elevation angle.

The planar treadmill means that the treadmill and the running deck thereon are in a planar form, so as to simulate runners running on a flat road. The curved treadmill means that the running deck and the running deck thereon are in a concave curved shape to provide a better running position, effectively reduce the impact of the runner and provide excellent training results; some studies have pointed out that the curved treadmill is a potential benefit to enhance walking capability for people with specific health needs, such as those with Parkinson's disease.

The powered treadmill refers to using a motor to the running deck to rotate through the drive wheel for the runner to run thereon. Treadmills without power are not equipped with motors for power. The running deck is driven to rotate by the friction of the runner when running on the running deck, so that the speed can be controlled naturally through the force of the runner.

The treadmill with adjustable elevation angle refers to the upward tilt angle that can be adjusted at the front end of the treadmill, so as to simulate runners running on slopes with different angles. Treadmills that cannot adjust the elevation angle do not provide this function.

The aforementioned various types of treadmills have one thing in common, that is, the shoes worn by the runner interacts with the treadmill via the friction of the material of the shoes, so it is impossible to further improve the resistance that runner experiences when the foot is raised; however, the resistance is needed for runners who need special training.

SUMMARY OF THE INVENTION

A primary objective of the present invention is to provide a resistance treadmill with a curved running deck, so that when the runner is running, the shoes and the treadmill can be attached and separated from each other, so that resistance is generated when the foot is lifted, therefore, suitable for runners who need special training.

The present invention provides a resistance treadmill with a curved running deck, comprising: a base, a pair of first drive wheels and a pair of second drive wheels respectively configured at opposite ends of the base, a pair of curved rods recessed downwards being disposed between the pair of first drive wheels and the pair of second drive wheels, and the pair of curved rods being located above the center of circle of the pair of first drive wheels and above the center of the circle of the pair of second drive wheels; a pair of conveyors, connecting the pair of first drive wheels and the pair of second drive wheels, so that the pair of first drive wheels and the pair of second drive wheels being linked to drive and rotate mutually; a plurality of running strips, arranged along the circumference of the pair of conveyors, opposite ends of each of the plurality of running strips being respectively fixed to the pair of conveyors, and a portion of the plurality of running strips located above the base being supported by the pair of curved rods, the plurality of running strips moving as the conveyor rotating around the pair of first drive wheels and the pair of second drive wheels; a plurality of first attachment elements being respectively disposed on the upper surface of each of the plurality of running strips; and at least one second attachment element for combining with at least one shoe of the runner or at least one foot of the runner, the second attachment element being detachably attached to the first attachment element. As such, the runner must apply a certain degree of force to separate the shoe from the conveyor when lifting the foot during running, so that the objective of special running training can be achieved by increasing the resistance.

In a preferred embodiment of the present invention, each of the first attachment elements has a first substrate, the upper surface of the first substrate is provided with a hook and loop felt; and the second attachment element has a second substrate for matching the shoe, the lower surface of the second substrate is provided with hook and loop felt. The Velcro felt and the Velcro hook felt together form a commonly called "Velcro tape" or "hook and loop tape", and the resistance is improved by the mutual adhesion structure between the Velcro felt and the Velcro hook felt.

In a preferred embodiment of the present invention, each of the first attachment elements has a first substrate, the upper surface of the first substrate is provided with at least one first magnet, and the second attachment element has a second substrate matching to the shoe or the foot, the lower surface of the second substrate is provided with at least one second magnet, and the first magnet and the second magnet have different magnetic properties. The resistance is increased by the magnetic attraction force between the first magnet and the second magnet.

In a preferred embodiment of the present invention, each of the first attachment elements has a first substrate, the upper surface of the first substrate is provided with at least one suction cup, and the second attachment element has a second substrate matching to the shoe or the foot, the lower surface of the second substrate has a flat surface capable of generating adsorption with the at least one suction cup, or the lower surface of the second substrate is provided with the at least one suction cup, and the upper surface of the first substrate has a flat surface capable of generating adsorption with the at least one suction cup. The resistance is improved by the vacuum suction generated between the suction cup and the flat surface.

In a preferred embodiment of the present invention, each of the first attachment elements has a first substrate, the upper surface of the first substrate is provided with a first gel element, and the second attachment element has a second substrate matching to the shoe or the foot, the lower surface of the second substrate is provided with a second gel element that can adhere to the first gel element. The resistance is improved by the adhesion between the first gel element and the second gel element.

In a preferred embodiment of the present invention, the running strip includes: a strip-shaped body disposed with a pair of wings located on opposite sides thereof; and a pair of press strips correspondingly arranged above the pair of wings, wherein, the opposite sides of the first substrate are respectively wrapping around the pair of press strips, the pair of press strips wrapped by the first substrate are arranged on the upper surface of the pair of wings, and at least one fixing element is used to fix the first substrate, the pair of press strips and the pair of wings to one another. As such, the first attachment element is firmly combined with the running strip, and can be replaced conveniently after the first attachment element is worn out.

In a preferred embodiment of the present invention, the running strip includes: a strip-shaped body; and a press plate, correspondingly arranged above the strip-shaped body, wherein the first substrate wraps around the press plate, and the press plate wrapped by the first substrate is arranged on the upper surface of the strip-shaped body, and at least one fixing element is used to fix the first substrate, the press plate and the strip-shaped body to one another. Similarly, as such, the first attachment element is firmly combined with the running strip, and can be easily replaced after the first attachment element is worn out.

A preferred embodiment of the present invention further includes a first motor disposed on the base, and the first motor is used to drive the pair of first drive wheels to rotate. The first motor provides power to drive the running strip to rotate along with the conveyor, so as to lead the runner to run easily.

A preferred embodiment of the present invention further includes an angle adjustment device for adjusting the elevation angle of one end of the base, and the angle adjustment device includes: a movable foot, rotatably arranged near the pair of second drive wheels at one end of the base, and the lower end of the movable foot is in contact with the ground; and an actuation device, disposed at the base to apply force to the movable foot so that the movable foot rotates with respect to the base, thereby changing the elevation angle of the base. As such, the inclination angle of the treadmill can be adjusted to simulate running on a slope.

Preferably, the actuation device includes: a screw cylinder having a cylinder barrel and a cylinder shaft partially disposed in the cylinder barrel, one end of the cylinder barrel is rotatably connected to the movable foot; and a second motor, connected to the cylinder shaft through a speed reducer, and used to drive the cylinder shaft and the cylinder barrel to move axially relative to each other, so as to change the elevation angle of the base.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
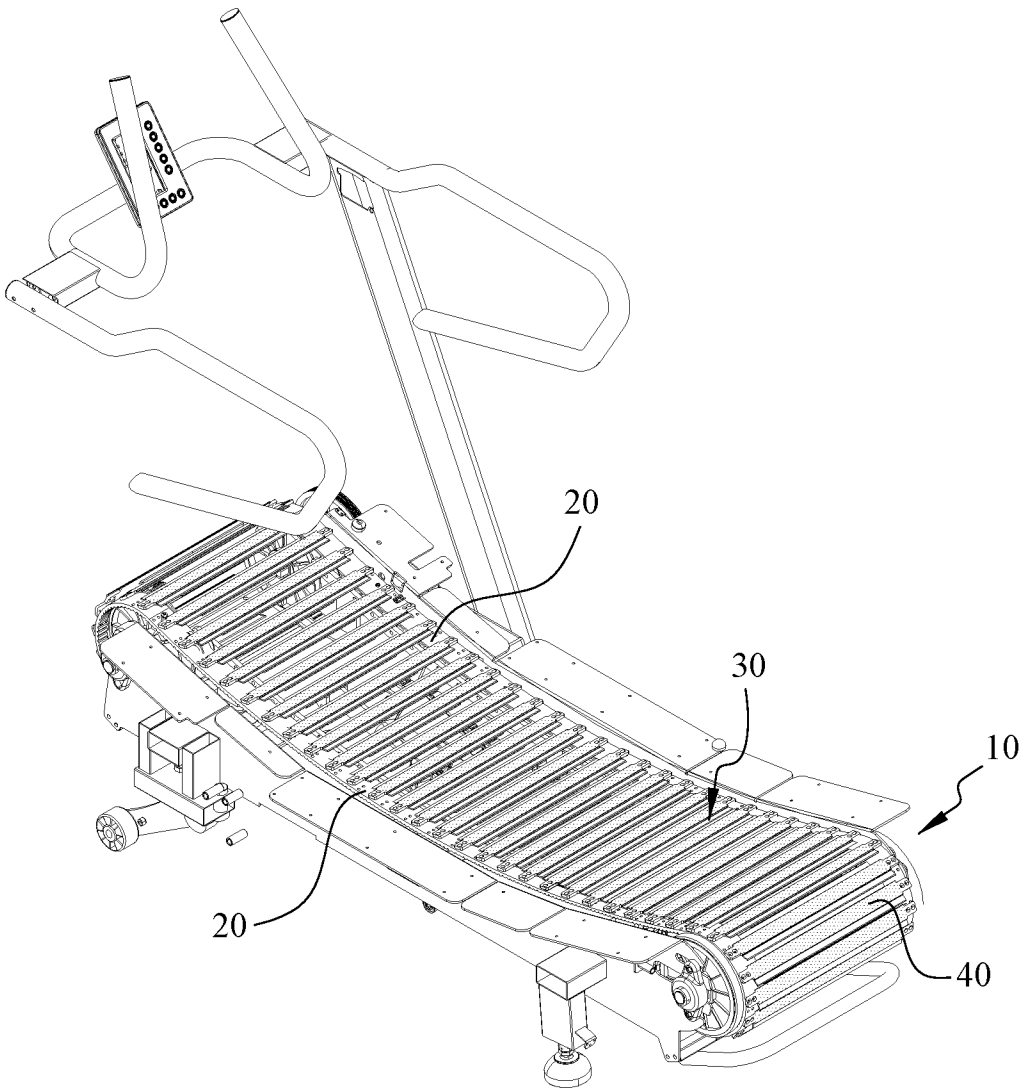
FIG. 1 is the three-dimensional schematic view showing the treadmill of the present invention.
Figure 2:
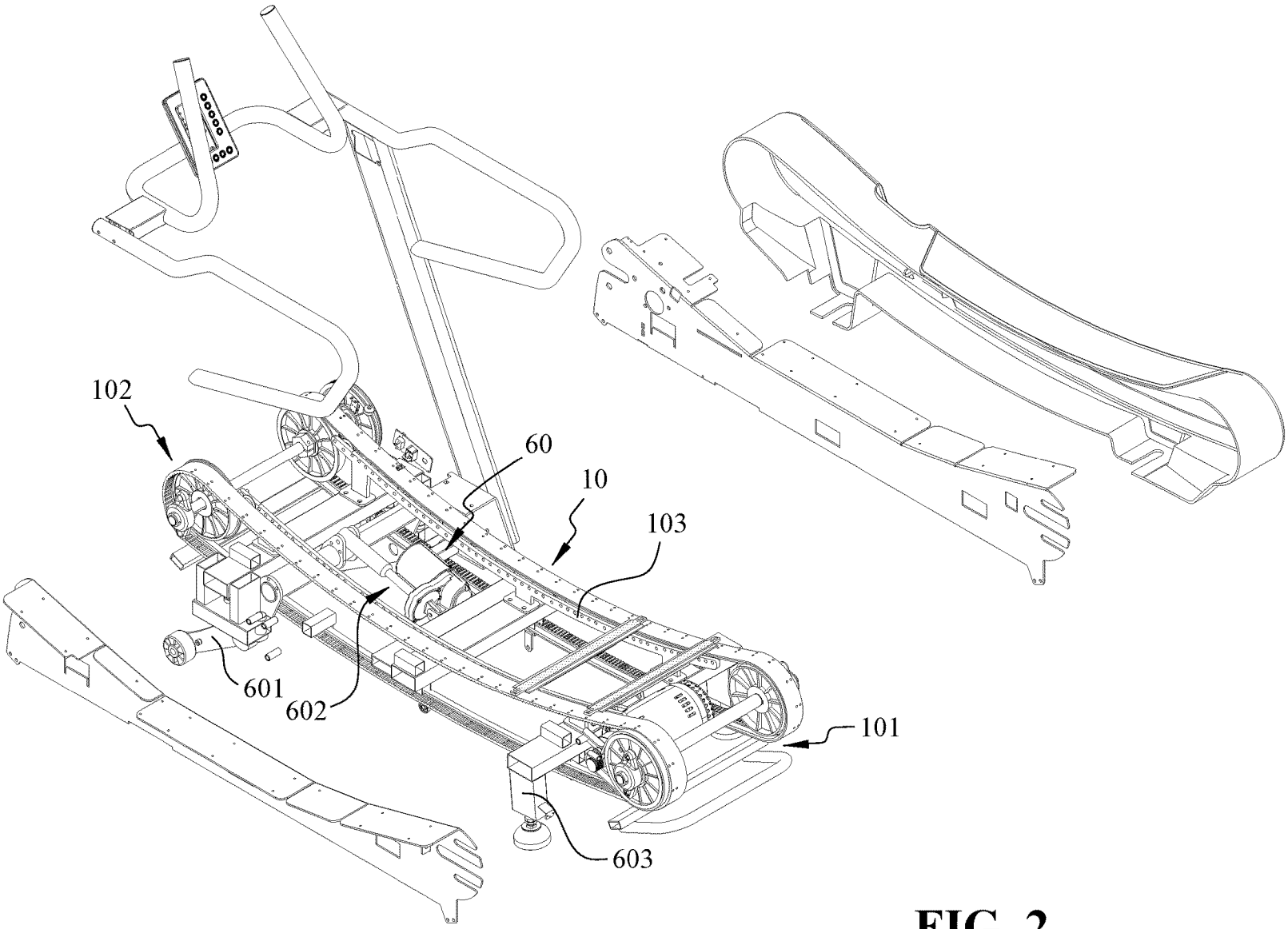
FIG. 2 is a three-dimensional exploded schematic view showing the structure of the treadmill of the present invention.

In order to facilitate understanding of the present invention, the present invention will be described in detail below in conjunction with accompanying drawings and embodiments. The drawings show some, but not all, embodiments of the present invention. The present invention can be implemented in many different forms and is not limited to the embodiments described herein. On the contrary, these embodiments are provided to make the understanding of the disclosure of the present invention more thorough and comprehensive. Based on the embodiments of the present invention, all other embodiments obtained by persons of ordinary skill in the art without making progressive efforts belong to the scope of the present invention.

Unless otherwise defined, all technical and scientific terms used herein have the same meaning as commonly understood by those skilled in the technical field of the present invention. The terms used in the description of the present invention are only for the purpose of describing specific embodiments, and are not intended to limit the present invention.

Terms such as "first" and "second" described below are intended to distinguish components, and are not used to limit the sequence of components in configuration or installation.

As shown in FIGS. 1 to 4, the resistance treadmill with curved running deck provided by the present invention has a base 10, a pair of first drive wheels 101 and a pair of second drive wheels 102 respectively configured at opposite ends of the base 10, a pair of curved rods 103 recessed downwards disposed between the pair of first drive wheels 101 and the pair of second drive wheels 102, and the pair of curved rods 103 is located above the center of circle C1 of the pair of first drive wheels 101 and above the center of the circle C2 of the pair of second drive wheels 102. A pair of conveyors 20 connects the pair of first drive wheels 101 and the pair of second drive wheels 10, so that the pair of first drive wheels 101 and the pair of second drive wheels 102 are linked to drive and rotate mutually. A plurality of running strips 30 is arranged along the circumference of the pair of conveyors 20, opposite ends of each of the plurality of running strips 30 are respectively fixed to the pair of conveyors 20, and the plurality of running strips moves as the conveyors 20 rotate around the pair of first drive wheels 101 and the pair of second drive wheels 102. A plurality of first attachment elements 40 is respectively disposed on the upper surface of each of the plurality of running strips 30 and the first attachment element 40 is used to be detachably adhered to a second attachment element 50 which is attached to a foot or a shoe.

In more detail, the first drive wheel 101 and the second drive wheel 102 arranged at opposite ends of the base 10 may be a timing pulley; and the conveyor 20 connecting the first drive wheel 101 and the second drive wheel 102 may be a timing belt. By matching the timing belt and the timing pulley, the first drive wheel 101 and the second drive wheel 102 can reliably drive the conveyor 20 to rotate. In some embodiments of the present invention, no motor is provided to drive the first drive wheel 101 or the second drive wheel 102, allowing the runner to push the running strips 30 to rotate with the conveyor 20 when running on the running deck. But in another embodiment, a first motor 104 can be added on the base 10. The first motor 104 drives the pair of first drive wheels 101 to rotate through a first speed reducer 105; for example, an approach of arranging the driving pulley on the output shaft of the first speed reducer 105 and the passive pulley (not shown) t on the central axis of the first drive wheel 101 can be adopted via a belt connection; or, a configuration of the driving gear on the output shaft of the first speed reducer 105 meshed with the driven gear (not shown) on the central shaft of the first drive wheel 101 can be used. Thus, when the first motor 104 drives the pair of first drive wheels 101 to rotate, the pair of second drive wheels 102 is driven to rotate through the conveyors 20, so that each running strips 30 rotates with the conveyors 20.

Figure 3:
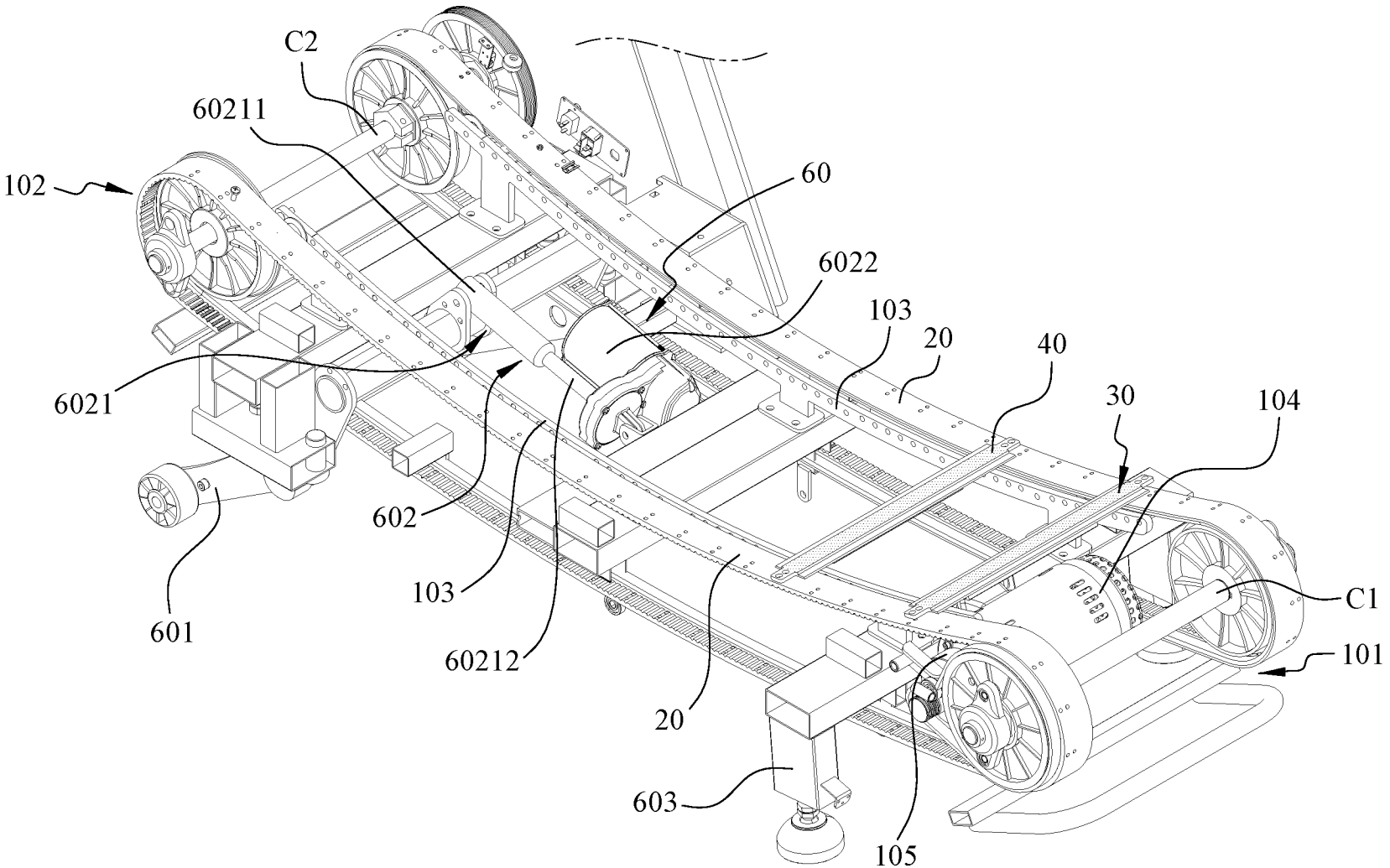
FIG. 3 is a three-dimensional enlarged view showing the structure of the treadmill of the present invention.

The pair of curved-shaped rods 103 are disposed on opposite sides of the base 10 and located on the side of the pair of conveyors 20 and lower than the lower surface of the pair of conveyors 20 (as shown in FIG. 3). Since the weight of each running strip 30 above the loop conveyor 20 plus the weight of the conveyor 20 will cause the conveyor 20 to sag, the drooping conveyor 20 and the running strip 30 will be supported by the pair of curved rods 103 t to form a concave curved, thereby forming a curved running deck.

Figure 6:
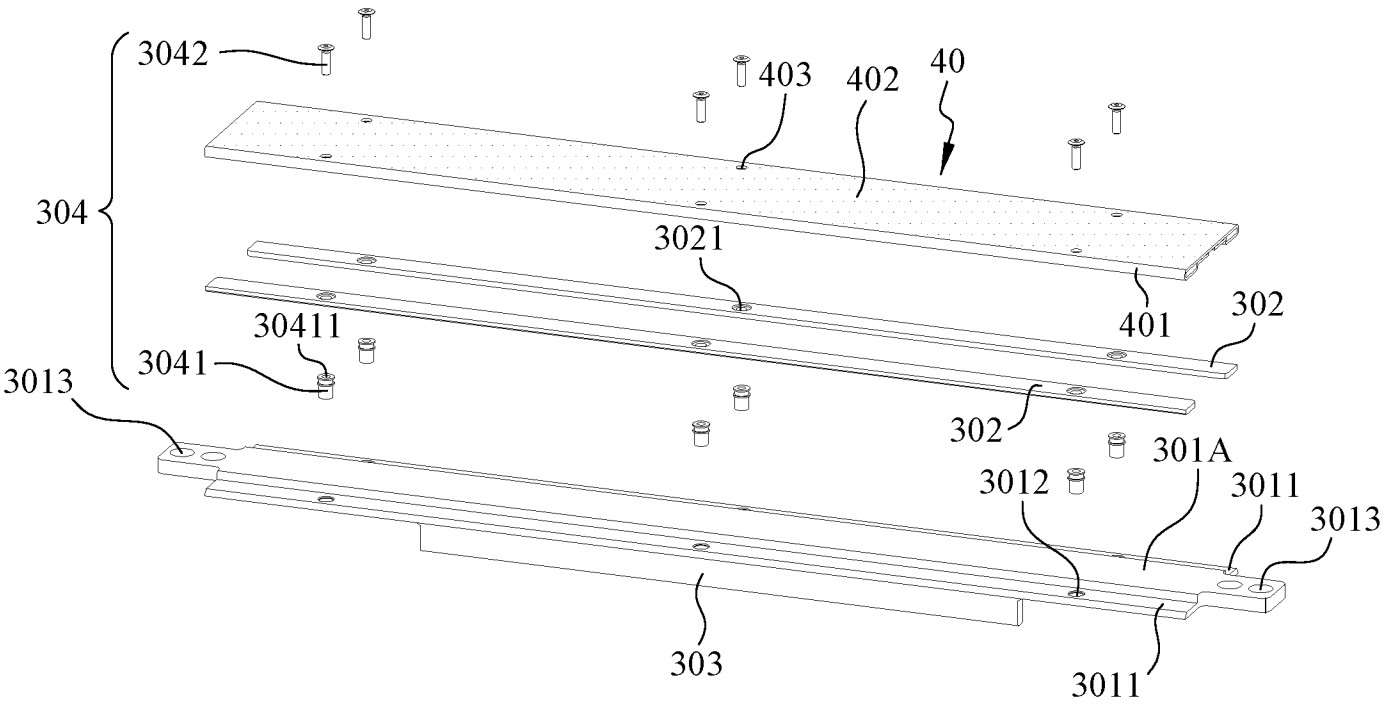
FIG. 6 is the three-dimensional exploded view showing the combination structure of the first embodiment of the running strip and the first attachment element in the treadmill of the present invention.

FIG. 6 shows the first embodiment of the running strip 30 of the present invention. In this embodiment, each of the plurality of running strips 30 includes: a strip-shaped body 301A and a pair of press strips 302; wherein, the strip-shaped body 301A is formed with a pair of wings 3011 on opposite sides thereof, each wing 3011 is provided with a plurality of fixing holes 3012, and at least one locking hole 3013 is respectively provided at opposite ends of the strip-shaped body 301A in the length direction. These locking holes 3013 provide locking elements (such as screws) to pass through to lock the running strip 30 to the conveyor 20. The bottom of the strip-shaped body 301A can also be integrally formed with reinforcing ribs 303, so that the strip-shaped body 301A is strong enough to bear the weight of the human body. The pair of press strips 302 is provided with a plurality of through holes 3021 for being correspondingly disposed above the pair of wings 3011. More specifically, the pair of wings 3011 extends horizontally from opposite sides of the strip-shaped body 301A, and the upper surface of the pair of wings 3011 is lower than the upper surface of the strip-shaped body 301A. The height difference between the upper surface of the wing 3011 and the upper surface of the strip-shaped body 301A is substantially equal to the thickness of the press strip 302. Accordingly, when the press strip 302 is placed on the wing 3011, the upper surface of the strip 302 and the surface of the upper surface of the strip-shaped body 301A are substantially leveled.

Figure 8:
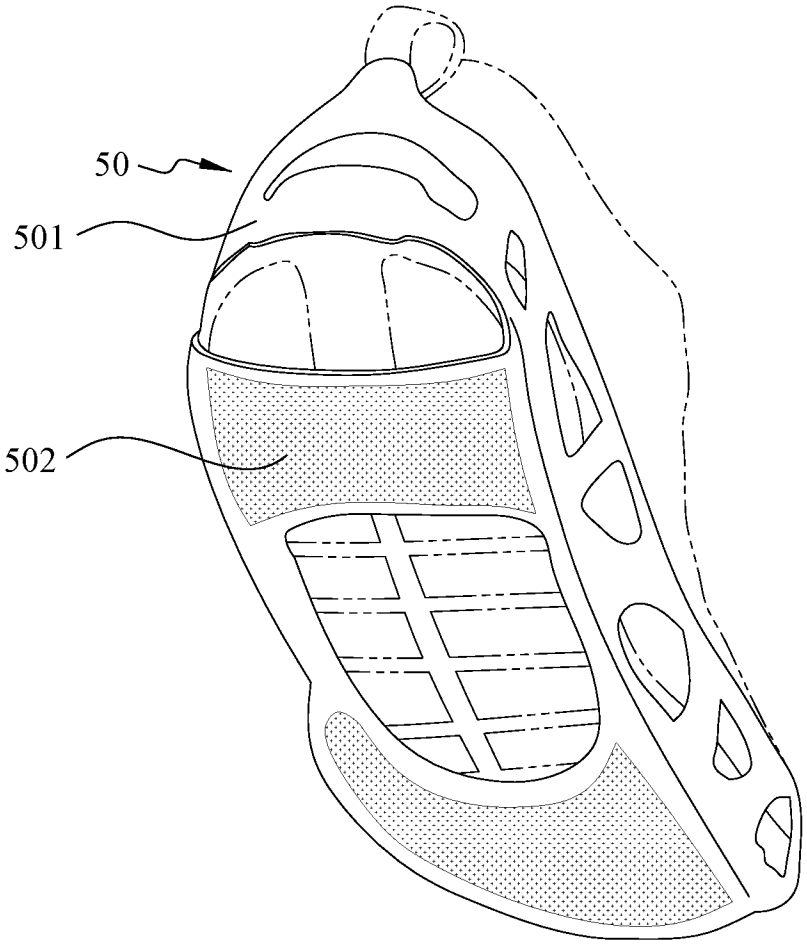
FIG. 8 is a schematic view showing an embodiment of the second attachment element in the treadmill of the present invention combined with shoes.

One of the embodiments of the present invention may use the commonly known as "Velcro tape" or "hook and loop tape" as the first attachment element 40 and the second attachment element 50 (as shown in FIG. 8); wherein, the first attachment element 40 has a first substrate 401, and a fastening felt 402 is disposed on the upper surface of the first substrate 401; a plurality of through holes 403 are also defined on the first attachment element 40. Accordingly, the opposite sides of the first substrate 401 can be respectively wrapped around each press strip 302, and the through hole 403 is made to correspond to the through hole 3021, and then the pair of press strips 302 wrapped by the first substrate 401 is arranged on the upper surface of the pair of wings 3011. Each fixing hole 3012 on the wing 3011 is made corresponding to the through hole 403 and the through hole 3021, and then the first substrate 401 and the pair of press strip 302 are fixed with the fixing element 304. The pair of wings 3011 are fixed to each other, that is, the opposite sides of the first substrate 401 are pressed and fixed between the wings 3011 and the press strip 302, so that the first attachment element 40 and the running strip 30 are integrated. As shown in FIG. 6, the fixing element 304 may be composed of a pull cap 3041 and a screw 3042, wherein the screw 3042 is assembled to the pull cap gun, and then the screw 3042 is locked into the screw hole 30411 at one end of the pull cap 3041, and then pass the other end of the pull cap 3041 through the through hole 403 of the first attachment element 40, the through hole 3021 of the press strip 302, and the fixing hole 3012 of the running strip 30 in sequence, and then operate the cap pull gun to pull the cap 3041. The other end is deformed to combine and fix the first attachment element 40 and the running strip 30. Alternatively, the fixing element 304 can also be implemented by a combination of screws and nuts, or any other suitable fixing elements.

Figure 7:
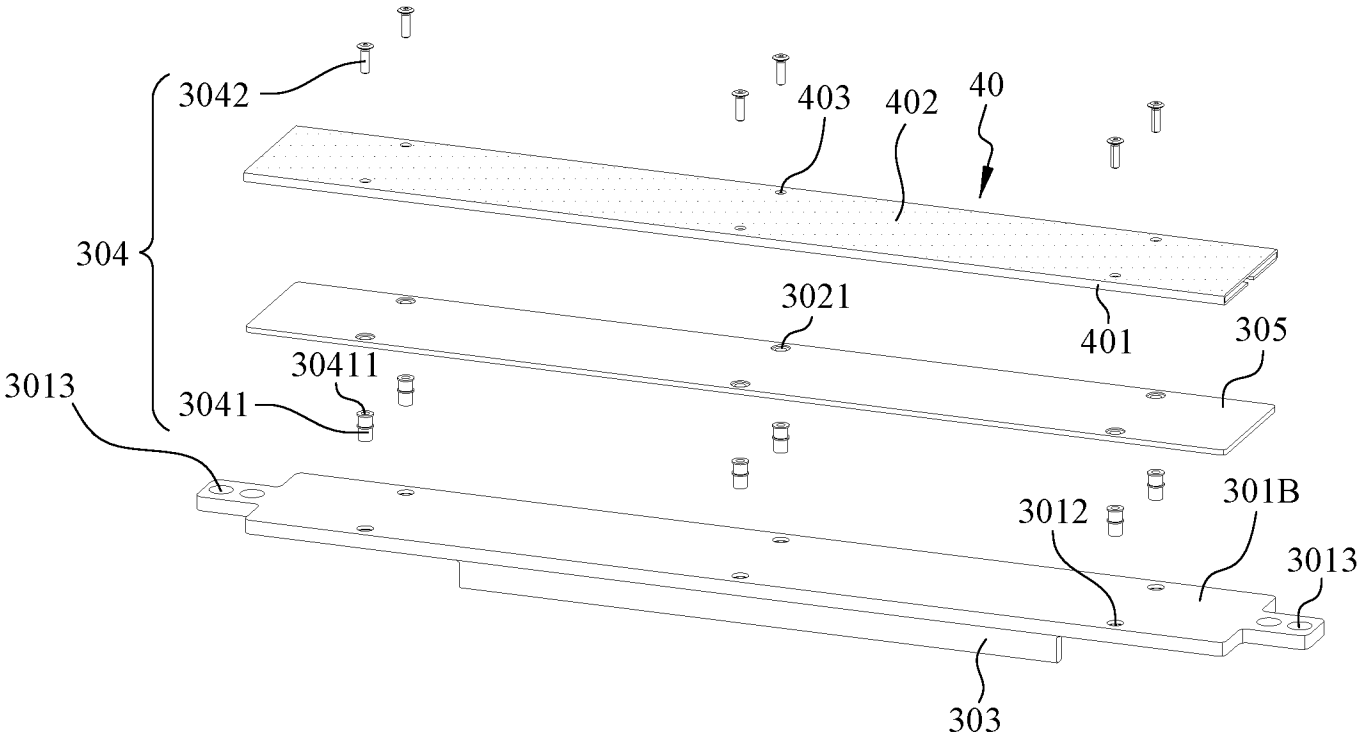
FIG. 7 is the three-dimensional exploded view showing the combined structure of the second embodiment of the running strip and the first attachment element in the treadmill of the present invention.

FIG. 7 shows a second embodiment of the running strip 30 of the present invention, that is, each of the plurality of running strips 30 includes: a strip-shaped body 301B and a press plate 305; wherein the strip-shaped body 301B is a strip-shaped flat plate, and a plurality of fixing holes 3012 are provided on the two opposite sides, and at least one locking hole 3013 is respectively set at the opposite ends of the length direction of the strip-shaped body 301B. The bottom of the strip-shaped body 301B can also be integrated with reinforcing rib 303 to enhance the strength of the strip-shaped body 301B enough to bear the weight of a human body. The press plate 305 is provided with a plurality of through holes 3021. One of the embodiments of the present invention may use the commonly known as "Velcro tape" or "hook and loop tape" as the first attachment element 40 and the second attachment element 50; wherein, the first attachment element 40 has a first substrate 401, and the upper surface of the first substrate 401 is provided with a fastening felt 402. The first attachment element 40 is also provided with a plurality of through holes 403. Accordingly, the opposite sides of the first substrate 401 of the first attachment element 40 can respectively wrap around the opposite sides of each press plate 305, and the through holes 403 correspond to the through holes 3021, and then the first press plate 305 wrapped by the first substrate 401 is placed on the upper surface of the strip-shaped body 301B. At the same time, each fixing hole 3012 of the strip-shaped body 301B corresponds to the through hole 403 and the through hole 3021, and then the first substrate 401 is fixed with the aforementioned fixing element 304, the press plate 305 and the strip-shaped body 301B are fixed to each other; that is, the opposite sides of the first substrate 401 are fixed between the strip-shaped body 301B and the press plate 305 by pressing, so that the first attachment element 40 and the running strip 30 is combined into one.

The second attachment element 50 is preferably formed in a form that can be matched to be combined to a foot or a shoe (e.g., a shoe cover). As shown in FIG. 8, the second attachment element 50 can be formed to be able to be fixedly combined to the bottom of the shoe to replace the sole, and it has a second substrate 501 as the body. The lower surface of the second substrate 501 is provided with a Velcro hook felt 502, the Velcro hook felt 502 is used for detachable adhesion with the aforementioned Velcro felt 402. The second attachment element 50 can be fixed to the shoes in any possible way, such as tying shoelaces, hat buckles, and so on.

Although not shown, the first attachment element and the second attachment element provided by the present invention can also use other methods to replace the previous hook and loop (or Velcro). For example, at least one first magnet may be arranged on the upper surface of the first substrate, and at least one second magnet may be arranged on the lower surface of the second substrate, and the first magnet and the second magnet have different magnetic properties. The resistance is increased by the magnetic attraction force between the first magnet and the second magnet. Alternatively, at least one suction cup can be set on the upper surface of the first substrate or the lower surface of the second substrate, and the lower surface of the second substrate or the upper surface of the first substrate can be formed to produce a surface for the adsorption effect with the at least one suction cup to increase the resistance by the vacuum suction generated between the suction cup and the surface. Alternatively, a first gel component (sticky as soft glue) can be set on the upper surface of the first substrate, and a second gel component that can be adhered to the first gel component is set on the lower surface of the second substrate (sticky as soft glue), the resistance is increased by the adhesion between the first gel element and the second gel element.

By means of the aforementioned resistance treadmill with an curved running deck of the present invention, when a runner whose shoes combined to the second attachment element 50 is running on the treadmill, due to the interaction between the first attachment element 40 and the second attachment element 50, the runner must spend more force to separate the second attachment element 50 from the first attachment element 40 when the runner lifts his feet. This resistance allows the runner to experience a greater amount of exercise, which is beneficial to those with specific health needs, particularly in walking capability, such as those with Parkinson's disease.

Moreover, in addition to be used in the treadmills unable to change the elevation angle, the resistance treadmill with curved running deck provided by the present invention is also applicable to treadmills with adjustable elevation angle. In the treadmill with adjustable elevation angle, an angle adjustment device 60 for adjusting the elevation angle at one end of the base 10 is provided on the base 10, and the angle adjustment device 60 includes a movable foot 601 and an actuation device 602, wherein the movable foot 601 is rotatably arranged at one end of the base 10 relatively close to the pair of second drive wheels 102. The lower end of the movable foot 601 touches the ground, and a fixed foot 603 is disposed at the other end of the base 10 for standing on the ground; the actuation device 602 is used to apply force to the movable foot 601 to make the movable foot 601 rotate with respect to the base 10, thereby changing the elevation angle of one end of the base 10.

Figure 4:
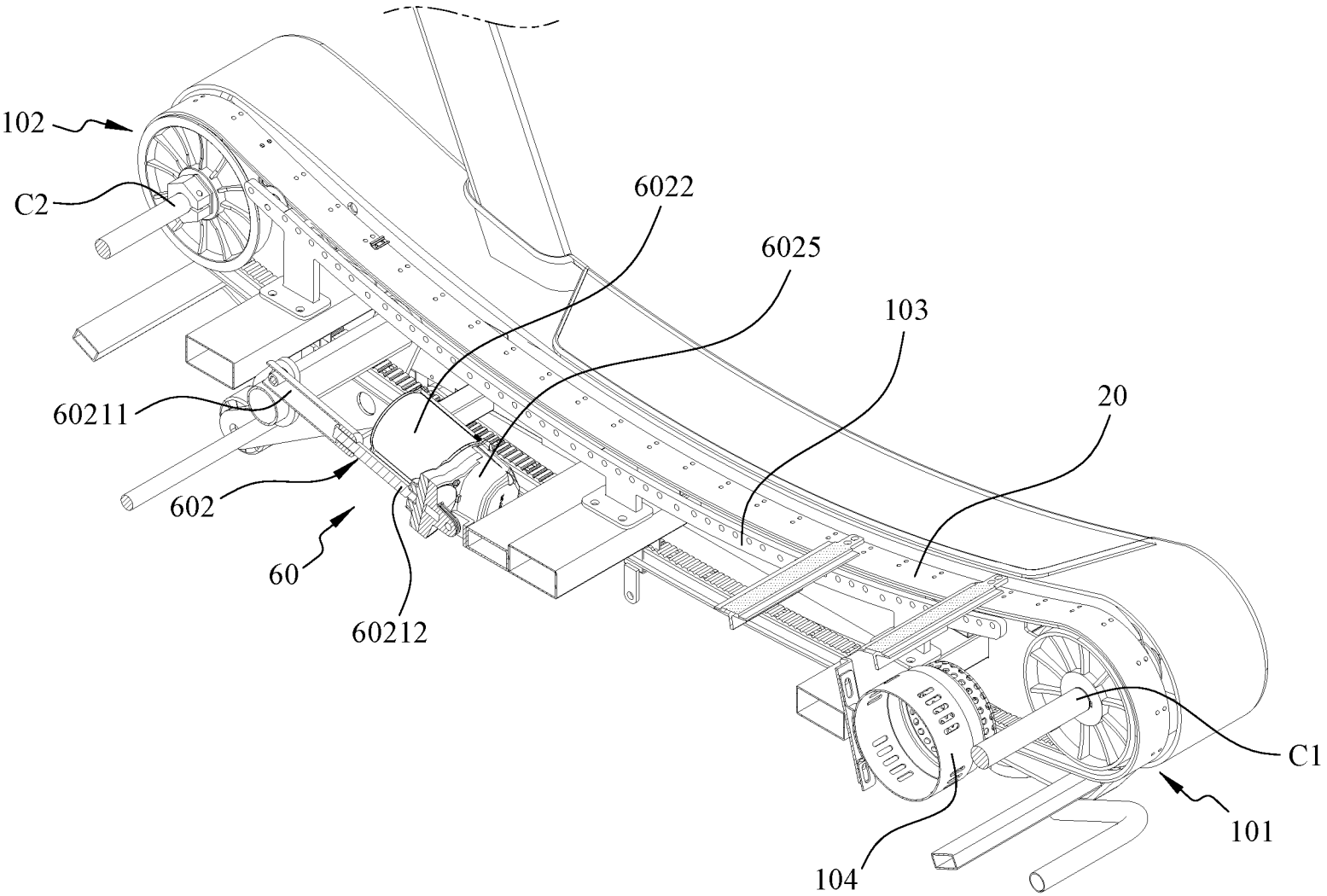
FIG. 4 is a three-dimensional cross-sectional view showing the structure of the treadmill of the present invention.
Figure 5:
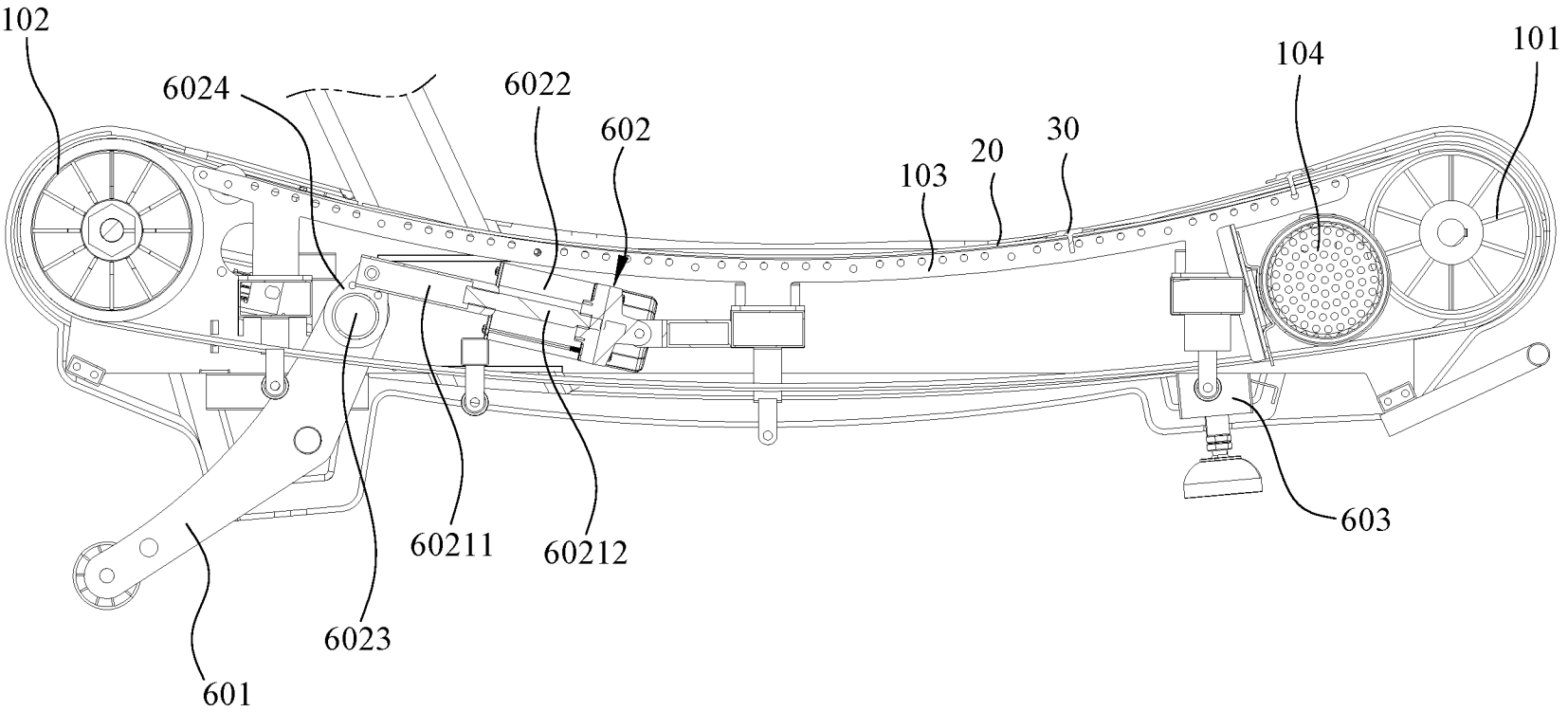
FIG. 5 is the planar cross-sectional view showing the treadmill structure of the present invention.

As shown in FIG. 4 and FIG. 5, specifically, the actuation device 602 includes: a screw cylinder 6021 and a second motor 6022; wherein, the screw cylinder 6021 has a cylinder 60211 and is partially arranged on the cylinder shaft 60212 in the cylinder 60211. One end of the cylinder 60211 is rotatably connected to the movable foot 601, for example, a pair of lugs 6024 are set on the rotating shaft 6023 of the base 10 connected to the movable foot 601, and one end of the cylinder 60211 is pivotally connected to the pair of lugs 6024. The second motor 6022 is connected to the cylinder shaft 60212 through a second speed reducer 6025, and when the second motor 6022 is activated, the cylinder shaft 60212 is driven to move axially with respect to the cylinder 60211, thereby changing the position of the base 10 relative to the ground to simulate road surfaces with different slopes.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A resistance treadmill with a curved running deck, comprising:

a base, having a pair of first drive wheels and a pair of second drive wheels respectively disposed at opposite ends of the base, a pair of curved rods recessed downwards being disposed between the pair of first drive wheels and the pair of second drive wheels, and the pair of curved rods being located above the center of circle of the pair of first drive wheels and above the center of the circle of the pair of second drive wheels;

a pair of conveyors, connecting the pair of first drive wheels and the pair of second drive wheels, so that the pair of first drive wheels and the pair of second drive wheels are linked to drive and rotate mutually;

a plurality of running strips, arranged along the circumference of the pair of conveyors, opposite ends of each of the plurality of running strips being respectively fixed to the pair of conveyors, and a portion of the plurality of running strips located above the base being supported by the pair of curved rods, the plurality of running strips moving as the conveyor rotates around the pair of first drive wheels and the pair of second drive wheels;

a plurality of first attachment elements being respectively disposed on the upper surface of each of the plurality of running strips; and at least one second attachment element for combining with at least one shoe of the runner or at least one foot of the runner, the second attachment element being detachably attached to the first attachment element.

2. The resistance treadmill with a curved running deck according to claim 1, wherein each of the first attachment elements has a first substrate, the upper surface of the first substrate is provided with a hook and loop felt; and the second attachment element has a second substrate for matching the shoe, the lower surface of the second substrate is provided with hook and loop felt.

3. The resistance treadmill with a curved running deck according to claim 2, wherein the running strip includes:

a strip-shaped body disposed with a pair of wings located on opposite sides thereof; and a pair of press strips correspondingly arranged above the pair of wings;

wherein, the opposite sides of the first substrate are respectively wrapping around the pair of press strips, the pair of press strips wrapped by the first substrate are arranged on the upper surface of the pair of wings, and at least one fixing element is used to fix the first substrate, the pair of press strips and the pair of wings to one another.

4. The resistance treadmill with a curved running deck according to claim 2, wherein the running strip includes:

a strip-shaped body; and a press plate, correspondingly arranged above the strip-shaped body;

wherein the first substrate wraps around the press plate, and the press plate wrapped by the first substrate is arranged on the upper surface of the strip-shaped body, and at least one fixing element is used to fix the first substrate, the press plate and the strip-shaped body to one another.

5. The resistance treadmill with a curved running deck according to claim 1, wherein each of the first attachment elements has a first substrate, the upper surface of the first substrate is provided with at least one first magnet, and the second attachment element has a second substrate matching to the shoe or the foot, the lower surface of the second substrate is provided with at least one second magnet, and the first magnet and the second magnet have different magnetic properties.

6. The resistance treadmill with a curved running deck according to claim 1, wherein each of the first attachment elements has a first substrate, the upper surface of the first substrate is provided with at least one suction cup, and the second attachment element has a second substrate matching to the shoe or the foot, the lower surface of the second substrate has a flat surface capable of generating adsorption with the at least one suction cup, or the lower surface of the second substrate is provided with the at least one suction cup, and the upper surface of the first substrate has a flat surface capable of generating adsorption with the at least one suction cup.

7. The resistance treadmill with a curved running deck according to claim 1, wherein each of the first attachment elements has a first substrate, the upper surface of the first substrate is provided with a first gel element, and the second attachment element has a second substrate matching to the shoe or the foot, the lower surface of the second substrate is provided with a second gel element that can adhere to the first element; wherein a resistance is provided by the adhesion between the first gel element and the second gel element.

8. The resistance treadmill with a curved running deck according to claim 1, further comprising a first motor disposed on the base, and the first motor being used to drive the pair of first drive wheels to rotate.

9. The resistance treadmill with a curved running deck according to claim 8, further comprising an angle adjustment device for adjusting the elevation angle of one end of the base, and the angle adjustment device comprising:

a movable foot, rotatably arranged near the pair of second drive wheels at one end of the base, and the lower end of the movable foot is in contact with the ground; and an actuation device, disposed at the base to apply force to the movable foot so that the movable foot rotates with respect to the base, thereby changing the elevation angle of the base.

10. The resistance treadmill with a curved running deck according to claim 9, wherein the actuation device includes:

a screw cylinder having a cylinder barrel and a cylinder shaft partially disposed in the cylinder barrel, one end of the cylinder barrel is rotatably connected to the movable foot; and a second motor, connected to the cylinder shaft through a speed reducer, and used to drive the cylinder shaft and the cylinder barrel to move axially relative to each other, so as to change the elevation angle of the base.

11. The resistance treadmill with a curved running deck according to claim 1, further comprising an angle adjustment device for adjusting the elevation angle of one end of the base, and the angle adjustment device comprising:

a movable foot, rotatably arranged near the pair of second drive wheels at one end of the base, and the lower end of the movable foot is in contact with the ground; and an actuation device, disposed at the base to apply force to the movable foot so that the movable foot rotates with respect to the base, thereby changing the elevation angle of the base.

12. The resistance treadmill with a curved running deck according to claim 11, wherein the actuation device includes:

a screw cylinder having a cylinder barrel and a cylinder shaft partially disposed in the cylinder barrel, one end of the cylinder barrel is rotatably connected to the movable foot; and a second motor, connected to the cylinder shaft through a speed reducer, and used to drive the cylinder shaft and the cylinder barrel to move axially relative to each other, so as to change the elevation angle of the base.

* * * * *